US006152557A

United States Patent [19]

Hagiwara et al.

[11] Patent Number: 6,152,557

[45] Date of Patent: Nov. 28, 2000

[54] ELECTROSTATIC INK JET RECORDER

[75] Inventors: Yoshihiro Hagiwara; Tadashi Mizoguchi; Junichi Suetsugu; Hitoshi Minemoto; Hitoshi Takemoto; Kazuo Shima; Toru Yakushiji, all of Niigata, Japan

[73] Assignee: NEC Corporation, Tokyo, Japan

[21] Appl. No.: 09/220,747

[22] Filed: Dec. 23, 1998

[30] Foreign Application Priority Data

Dec. 25, 1997 [JP] Japan ..... 9-356455

[51] Int. Cl.[7] ..... B41J 2/175

[52] U.S. Cl. ..... 347/85

[58] Field of Search ..... 347/84, 85, 86, 347/87, 89

[56] References Cited

U.S. PATENT DOCUMENTS

| | | | |
|---|---|---|---|
| 4,380,770 | 4/1983 | Maruyama | 347/89 |
| 4,432,003 | 2/1984 | Barbero et al. | 347/89 |
| 5,818,485 | 10/1998 | Rezanka | 347/89 |

FOREIGN PATENT DOCUMENTS

| | | |
|---|---|---|
| 61-112648 | 5/1986 | Japan . |
| 61-169254 | 7/1986 | Japan . |
| 6-64185 | 3/1994 | Japan . |
| 7-76094 | 3/1995 | Japan . |
| 7-76105 | 3/1995 | Japan . |
| 7-81084 | 3/1995 | Japan . |
| 77-81082 | 3/1995 | Japan . |
| 8-20111 | 1/1996 | Japan . |

*Primary Examiner*—N. Lee
*Assistant Examiner*—Anh T. N. Vo
*Attorney, Agent, or Firm*—Ostrolenk, Faber, Gerb & Soffen, LLP

[57] ABSTRACT

An electrostatic ink jet recorder of the present invention includes a head for ejecting ink, an ink reservoir storing the ink, and an ink feed pipe and an ink discharge pipe for circulating the ink between the head and the ink reservoir. The head has a first ink chamber communicated to the ink feed pipe, a second ink chamber communicated to the ink discharge pipe, a third ink chamber positioned at a higher level than the first and second ink chambers for ejecting the ink for printing, a siphon pipe communicating the first and third ink chamber and having a suction opening below an ink level in the first ink chamber, and an ink outlet pipe having an outlet opening above an ink level in the second ink chamber for delivering the ink from the third ink chamber to the second ink chamber. Delicate pressure variation in the head ascribable to the movement of the head is reduced in order to maintain pressure inside the third ink chamber for ejection stable.

4 Claims, 3 Drawing Sheets

ELECTROSTATIC INK JET RECORDER

BACKGROUND OF THE INVENTION

The present invention relates to an electrostatic ink jet recorder and more particularly to a mechanism for absorbing ink feed pressure inside a head included in an electrostatic ink jet recorder.

In an electrostatic ink jet recorder, a head and an ink reservoir or tank have been heretofore been improved in various ways in order to prevent ink from leaking from the head or to absorb pressure variation ascribable to the movement of the head. Electrostatic ink jet recorders with such improvements are taught in Japanese Patent Laid-Open Publication Nos. 61-112648 and 7-81082 by way of example. However, the recorder disclosed in Laid-Open Publication No. 61-112648 has a problem that delicate changes in pressure within a head and ascribable to the movement of the head cannot be effectively absorbed. The recorder proposed in Laid-Open Publication No. 7-81082 has a problem that bubbles are introduced in an ink reservoir during the circulation of ink, in addition to the problem of Laid-Open Publication No. 61-112648.

Technologies relating to the present invention are also disclosed in, e.g., Japanese Patent Laid-Open Publication Nos. 7-76094, 7-76105, and 7-81084.

SUMMARY OF THE INVENTION

It is therefore an object of the present invention to provide an electrostatic ink jet recorder capable of absorbing delicate pressure variation in a head ascribable to the movement of the head and thereby maintaining pressure inside an ink chamber stable and enhancing high quality printing.

An electrostatic ink jet recorder of the present invention includes a head for ejecting ink, an ink reservoir storing the ink, and an ink feed pipe and an ink discharge pipe for circulating the ink between the head and the ink reservoir. The head has a first ink chamber communicated to the ink feed pipe, a second ink chamber communicated to the ink discharge pipe, a third ink chamber positioned at a higher level than the first and second ink chambers for ejecting the ink for printing, a siphon pipe communicating the first and third ink chambers and having a suction opening below an ink level in the first ink chamber, and an ink outlet pipe having an outlet opening above an ink level in the second ink chamber for delivering the ink from the third ink chamber to the second ink chamber.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
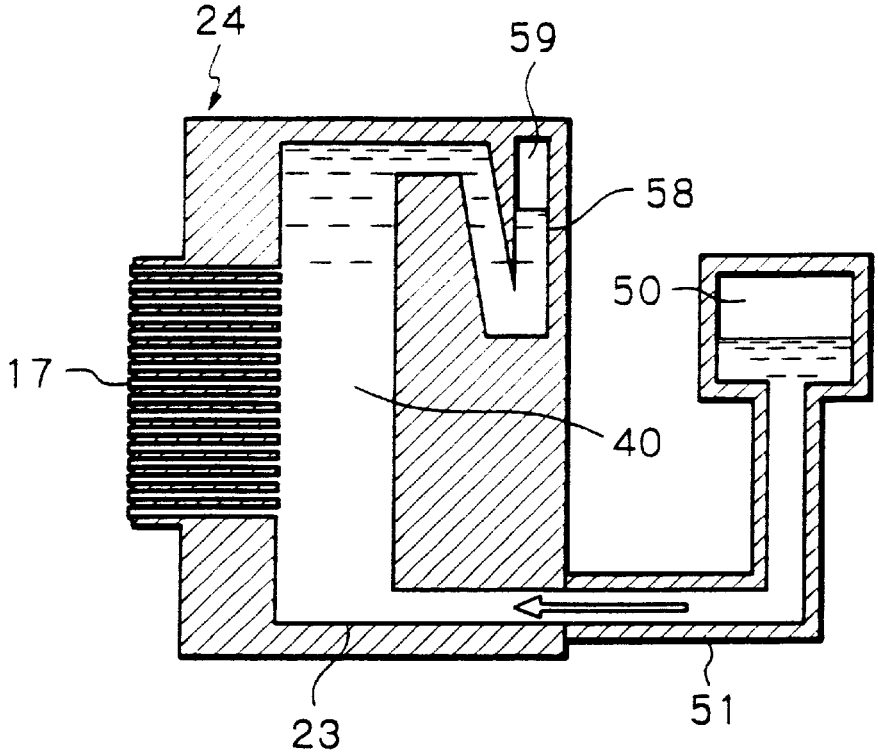
Fig. 1 PRIOR ART
FIG. 1 is a section showing a conventional electrostatic ink jet recorder.

To better understand the present invention, brief reference will be made to a conventional electrostatic ink jet recorder, shown in FIG. 1. The ink jet recorder to be described is taught in Japanese Patent Laid-Open Publication No. 61-112648 mentioned earlier. As shown, the ink jet recorder includes a head 24 formed with an ejecting portion 17 and an ink chamber 23 adjoining the ejecting portion 17. The ink chamber 23 is communicated at one end to an ink reservoir or tank 50 and at the other end to a pressure control pipe 58. The ink reservoir 50 stores ink 40. An air layer 59 is sealed in the pressure control pipe 58. Noticeable changes in the pressure in the ink chamber 23 are absorbed by changes in the volume of the air layer 59. However, the problem with this ink jet recorder is that delicate changes in pressure within the head 24 and ascribable to the movement of the head 24 cannot be effectively absorbed.

Figure 2:
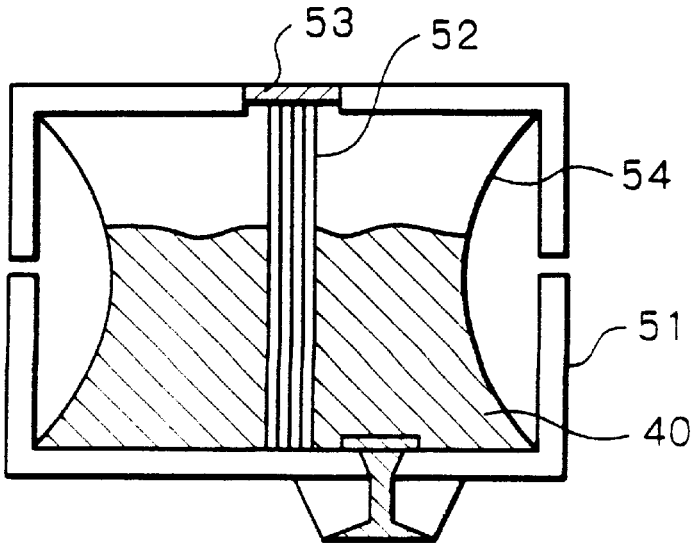
Fig. 2 PRIOR ART
FIG. 2 is a section showing another conventional electrostatic ink jet recorder.

FIG. 2 shows an ink reservoir 51 included in another conventional electrostatic ink jet recorder which is disclosed in Japanese Patent Laid-Open Publication No. 7-81082 also mentioned earlier. As shown, an elastic film 54 forms a part of the inner periphery of the ink reservoir 51 storing ink 40. A porous mesh-like member 53 is positioned at the top center of the ink reservoir 51. A capillary ink feed portion 52 feeds ink to the mesh-like member 53. Pressure inside the ink reservoir 51 is control led by the surface tension of the ink fed from the ink feed portion 52 to the mesh-like member 53 and the elastic film 54. The ink reservoir 51, however, has a problem that bubbles are introduced in the ink 40 during the circulation of the ink 40, in addition to the problem stated with reference to FIG. 1.

Figure 3:
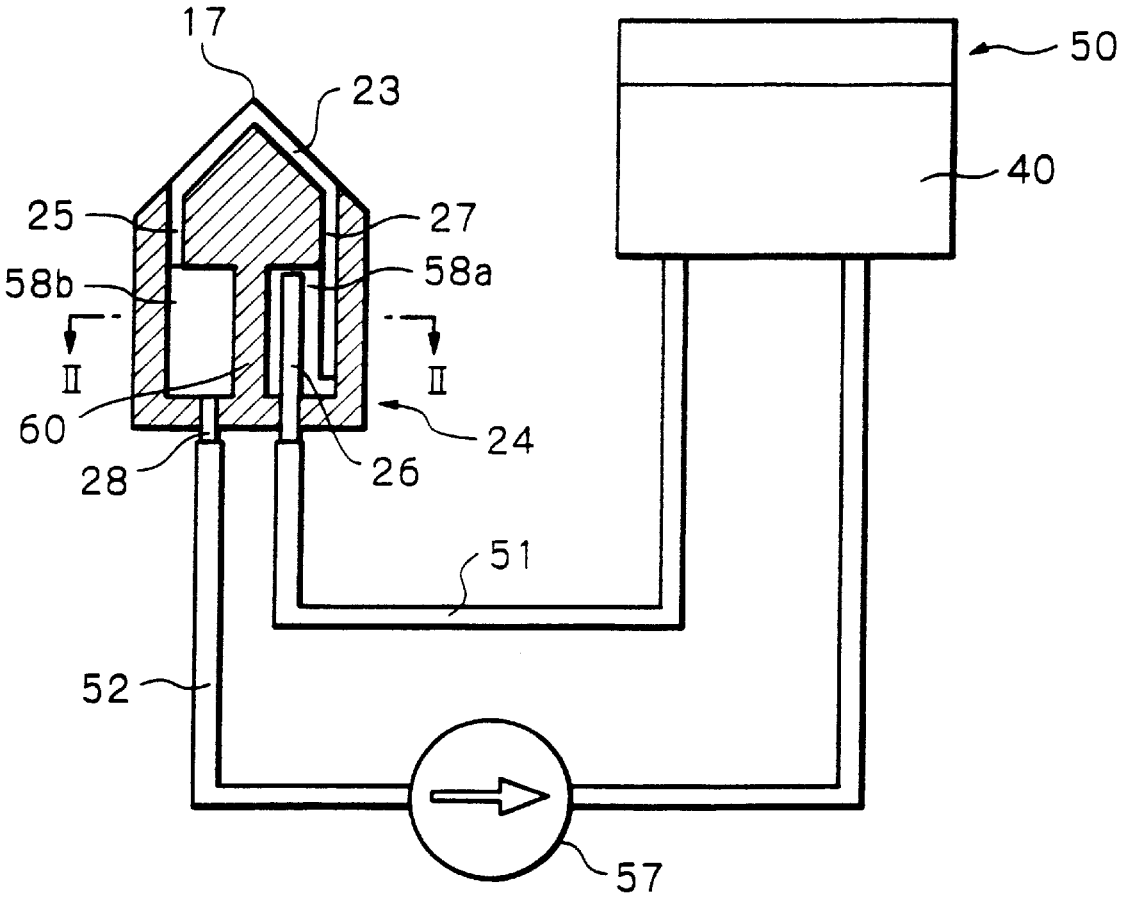
FIG. 3 is a section showing an electrostatic ink jet recorder embodying the present invention.

Referring to FIG. 3, an electrostatic ink jet recorder embodying the present invention will be described. As shown, the ink jet recorder is generally made up of a head 24, an ink reservoir 50 storing ink 40, and an ink feed pipe 51 and an ink discharge pipe 52 for circulating the ink 40 between the head 24 and reservoir 50. A pump 57 is positioned in the ink discharge pipe 52 for subjecting the ink 40 to vacuum. The head 24 has an ink ejecting portion 17 and an ink chamber 23 each having a conventional configuration.

Figure 4:
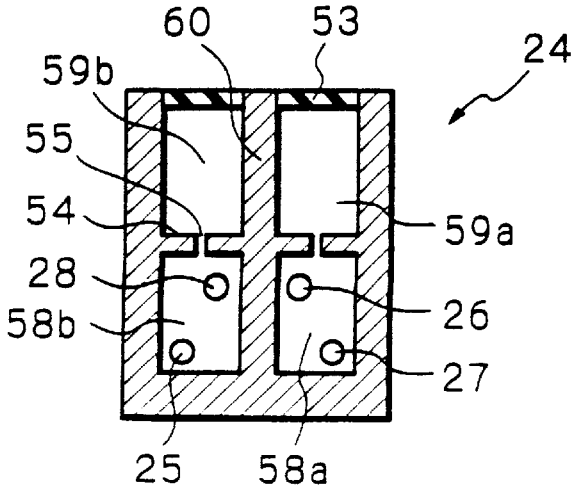
FIG. 4 is a section as seen in a direction II—II of FIG. 3.

As shown in FIG. 4 in a section, the head 24 has four spaces, two at the ink feed side and two at the ink discharge side, in addition to the ink chamber 23. That is, the head 24 has an ink chamber 58*a* and an air chamber 59*a* at the ink feed side and an ink chamber 58*b* and an air chamber 59*b* at the ink discharge side. The air chambers 59*a* and 59*b* each is delimited by an elastic film 53 at one end. A wall 54 separates the ink chamber 58*a* and air chamber 59*a* from each other. Likewise, a wall 54 separates the ink chamber 58*b* and air chamber 59*b* from each. The walls 54 each is formed with an aperture 55 so as to provide fluid communication between the air chamber 59*a* and ink chamber 58*a* or the air chamber 58*b* and ink chamber 59*b*. A wall 60 separates the ink inlet side and ink outlet side of the head 24 from each other.

As shown in FIG. 3, the ink reservoir 50 is communicated to the ink chamber 58*a* by the ink feed pipe 51 and an ink inlet pipe 26 extending from the pipe 51 into the ink chamber 58*a*. Specifically, the ink inlet pipe 26 extends upward into the ink chamber 58*a* and is open at its top. A siphon pipe or ink suction pipe 27 extends downward from the ink chamber 23 into the ink chamber 58*a* and is open at its bottom. The top of the siphon pipe 27 is communicated to an ink outlet pipe 25 via the ink chamber 23. The ink inlet pipe 26 and siphon pipe 27 each has a length determined in accordance with the required level of the ink. The bottom of the ink outlet pipe 25 is open at the top of the ink chamber 58*b*. An ink outlet port 28 is formed in the bottom of the ink chamber 58*b* and communicated to the ink discharge pipe 52.

The pump 57 is positioned at substantially the intermediate portion of the ink discharge pipe 52 connecting the ink reservoir 50 and ink chamber 58*b*. The pump 57 subjects the ink 40 in the ink chamber to a preselected degree of vacuum and thereby circulates the ink 40. Specifically, the pump 57 sucks the ink 40 out of the head 24 and feeds it to the ink reservoir 50, so that the ink chamber 23 is evacuated. Pressure in the air chambers 59*a* and 59*b* sequentially falls as the ink 40 is consumed due to ejection. As a result, the ink 40 is replenished from the ink reservoir 50 to the ink chamber 23 via the ink feed pipe 51. The ink 40 in the ink ejecting portion 17 forms a meniscus at the tip of the section 17 contacting the atmospheric air. The flow rate of the pump 57 is selected to be greater than a pressure loss inside the ink feed pipe 51 extending from the ink reservoir 50 to the ink chamber 23, but smaller than the weakest capillary force to act in the ink ejecting portion 17. It follows that the vacuum acting in the ink chamber 23 does not draw the meniscus of the ink 40.

Figure 5C:
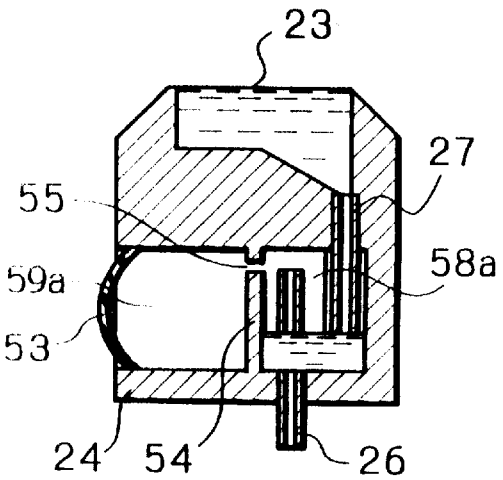
FIGS. 5A–5C are sections each showing a head included in the illustrative embodiment in a particular condition.
Figure 5B:
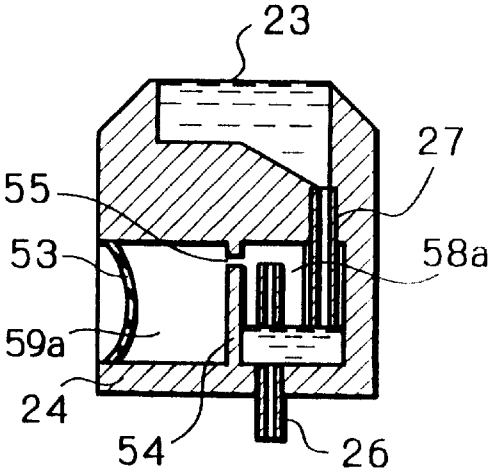
Figure 5A:
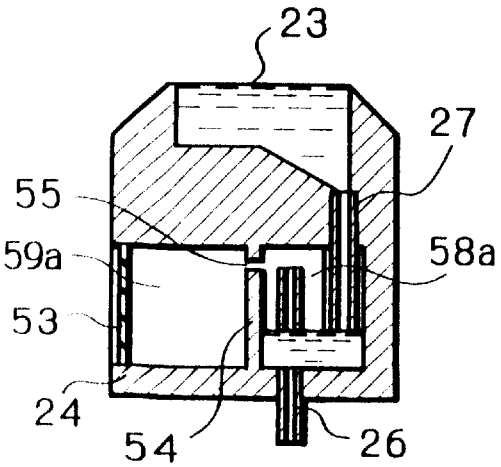

FIGS. 5A–5C each shows head 24 of the illustrative embodiment in a particular condition. FIG. 5A shows a condition wherein the ink is admitted into the head 24. As shown, when the pump 57 is energized to suck the ink in the ink chamber 58*a* via the siphon pipe 27, pressure in the chamber 58*a* falls with the result that a pressure difference occurs between the chamber 58*a* and the ink reservoir 50. Consequently, the ink 40 flows from the reservoir 50 toward the ink chamber 23 via the ink feed pipe 51. The ink 40 flows into the ink chamber 58*a* via the top of the ink inlet pipe 26 and stays in the bottom portion of the chamber 58*a*. This part of the ink 40 is sucked into the siphon pipe 27 while leaving a space thereabove in the ink chamber 58*a*, and then brought to the ink chamber 23. The ink 40 drawn away from the ink chamber 23 is introduced into the ink chamber 58*b* via the ink outlet pipe 25 and then returned to the reservoir 50 via the ink outlet port 28 and ink discharge pipe 52. In this manner, the ink 40 is constantly circulated through the head 24 and reservoir 50 so long as it is free from extraneous pressures. Because the ink chambers 58*a* and 58*b* are subjected to vacuum, the elastic films 53 each is deformed inward due to a pressure difference between the associated ink chamber and the outside, as illustrated in FIG. 5B.

Assume that the head 24 is moved in the right-and-left direction, causing the resulting inertia force to act on the ink 40 in the ink feed pipe 51 and ink discharge pipe 52. Then, the pressure of the ink 40 varies and causes pressure waves to be propagated. In addition, vibration around the pump 57 disposed in the ink discharge pipe 52 is also propagated via the ink 40. Such pressure waves are attenuated by the variation of the volumes of air existing in the air chambers 59*a* and 59*b*. Therefore, the pressure waves are reduced both in oscillation period and in maximum value before reaching the ink chamber 23. When the pressures in the air chambers 59*a* and 59*b* vary, the elastic films 53 associated therewith deform accordingly.

For example, assume that the pressure in the air chamber 59*a* or 59*b* is P (Pa), that the air chamber 59*a* or 59*b* has a volume of V (m3), and that the volume coefficient of the deformation of the film 53 is K (m3/Pa). Then, when the pressure P varies by $\Delta P$(Pa) to $P+\Delta P$(Pa), the deformation volume V (m3) of the film 53 is equal to $K\times\Delta P$. A pressure variation $(P+\Delta P)\times V$ ascribable to the variation of the volume is equal to $(P+\Delta P2)\times(V+\Delta V)$ and to $(P+\Delta P2)\times(V+K\times\Delta P)$. It follows that when P is zero in terms of gauge pressure, the pressure attenuation ratio $\Delta P2/\Delta P$ is equal to $V/(V+K\Delta P)$. For example, if $K\Delta P$ is 0.5V, then the pressure attenuation ratio is 67%. When the pressure in the air chamber is positive, as sometimes occurs, the film 53 deforms outward, as shown in FIG. 5C.

The walls 54 formed with apertures 55 respectively separate the ink chambers 58*a* and air chamber 59*a* and the ink chamber 58*b* and air chamber 59*b*, as stated earlier. The apertures 55 each is positioned above the ink level and therefore allows the air, but not ink, to pass therethrough. The elastic films 53 therefore do not directly contact the ink 40 and are free from deterioration ascribable to the ink 40. Further, the surfaces of the films 53 are parallel to the direction in which the head 24 moves. Therefore, during the movement of the head 24, the inertia force derived from the mass of each film 53 acts in parallel to the film 53 and does not produce any undesirable pressure variation.

In summary, in accordance with the present invention, an electrostatic ink jet recorder includes a head formed with ink chambers separate from each other. In this configuration, any pressure variation is absorbed by the variation of the volume of air in the ink chambers. The head therefore stabilizes ink at its ejecting portion and thereby enhances high quality printing and can be provided with a miniature configuration including a pressure absorbing mechanism.

Various modifications will become possible for those skilled in the art after receiving the teachings of the present disclosure without departing from the scope thereof.

What is claimed is:

1. An electrostatic ink jet recorder comprising:

a head for ejecting ink;

an ink reservoir storing the ink; and an ink feed pipe and an ink discharge pipe for circulating the ink between said head and said ink reservoir;

said head comprising:

a first ink chamber communicated to said ink feed pipe;

a second ink chamber communicated to said ink discharge pipe;

a third ink chamber positioned at a higher level than said first ink chamber and said second ink chamber for ejecting the ink for printing;

a siphon pipe communicating said first ink chamber and said third ink chamber and having a suction opening below an ink level in said first ink chamber; and an ink outlet pipe having an outlet opening above an ink level in said second ink chamber for delivering the ink from said third ink chamber to said second ink chamber.

2. An electronic ink jet recorder comprising:

a head for ejecting ink;

an ink reservoir storing the ink; and an ink feed pipe and an ink discharge pipe for circulating the ink between said head and said ink reservoir;

said head comprising:

a first ink chamber communicated to said ink feed pipe;

a second ink chamber communicated to said ink discharge pipe;

a third ink chamber positioned at a higher level than said first ink chamber and said second ink chamber for ejecting the ink for printing;

a siphon pipe communicating said first ink chamber and said third ink chamber and having a suction opening below an ink level in said first ink chamber;

an ink outlet pipe having an outlet opening above an ink level in said second ink chamber for delivering the ink from said third ink chamber to said second ink chamber;

a first air chamber communicated to said first ink chamber, but not admitting the ink thereinto; and a second air chamber communicated to said second ink chamber but not admitting the ink thereinto.

3. A recorder as claimed in claim 2, wherein said first air chamber and said second air chamber each is delimited at one end by a wall at least partly constituted by an elastic film.

4. A recorder as claimed in claim 3, wherein said elastic film is positioned parallel to a direction in which said head is movable.

* * * * *